US011357304B2

(12) United States Patent
Kuri Tanus

(10) Patent No.: US 11,357,304 B2
(45) Date of Patent: Jun. 14, 2022

(54) SYSTEMS AND METHODS FOR A COMPRESSIBLE POUCH

(71) Applicant: Poketins LLC, Houston, TX (US)

(72) Inventor: Isabel Kuri Tanus, Houston, TX (US)

(73) Assignee: Poketins LLC, Houston, TX (US)

( * ) Notice: Subject to any disclaimer, the term of this patent is extended or adjusted under 35 U.S.C. 154(b) by 0 days.

(21) Appl. No.: 17/406,198

(22) Filed: Aug. 19, 2021

(65) Prior Publication Data

US 2021/0378376 A1 Dec. 9, 2021

Related U.S. Application Data

(63) Continuation of application No. PCT/US2020/026284, filed on Apr. 2, 2020, which is a continuation-in-part of application No. 16/822,245, filed on Mar. 18, 2020, now abandoned, which is a continuation of application No. 16/503,519, filed on Jul. 4, 2019, now abandoned.

(51) Int. Cl.

| | |
|---|---|
| ***A45C 13/02*** | (2006.01) |
| ***A45C 13/10*** | (2006.01) |
| ***A45C 7/00*** | (2006.01) |

(52) U.S. Cl.

CPC ..... *A45C 13/02* (2013.01); *A45C 7/0077* (2013.01); *A45C 13/103* (2013.01)

(58) Field of Classification Search

CPC ..... A45C 13/02; A45C 7/0077; A45C 13/103
See application file for complete search history.

(56) References Cited

U.S. PATENT DOCUMENTS

| | | | | | |
|---|---|---|---|---|---|
| 522,809 | A * | 7/1894 | Tompkins | A45F 5/00 | 224/220 |
| 2,729,257 | A * | 1/1956 | Kepper | A45C 7/0068 | 383/2 |
| 3,292,748 | A * | 12/1966 | Arnolds | A45C 3/00 | 190/119 |
| 3,443,671 | A * | 5/1969 | Dyke | A45C 7/0027 | 190/103 |
| 5,431,265 | A * | 7/1995 | Yoo | A45C 3/00 | 190/103 |
| 6,047,752 | A * | 4/2000 | Southwick | A45C 3/00 | 150/112 |
| 6,179,182 | B1 * | 1/2001 | Hayes | A45C 3/00 | 224/408 |
| 6,505,765 | B1 * | 1/2003 | Proctor | A45C 7/0063 | 224/413 |
| 6,558,062 | B1 * | 5/2003 | Wyant | A45C 7/0068 | 206/425 |
| 6,568,852 | B1 * | 5/2003 | Godshaw | A45C 7/0068 | 190/103 |
| 2005/0286807 | A1 * | 12/2005 | Matheus | A45C 7/0063 | 383/2 |
| 2015/0135646 | A1 * | 5/2015 | Goenka | B65D 85/07 | 53/436 |

* cited by examiner

*Primary Examiner* — Tri M Mai
(74) *Attorney, Agent, or Firm* — Pierson IP, PLLC

(57) ABSTRACT

Systems and methods for a compression pouch with a rear shell and a front shell that are coupled together with a compressible layer, wherein the compressible layer is configured to open and close via a zipper, and a coupling mechanism positioned on the front shell and a flap.

20 Claims, 4 Drawing Sheets

SYSTEMS AND METHODS FOR A COMPRESSIBLE POUCH

CROSS-REFERENCE TO RELATED APPLICATIONS

This application claims a benefit of priority as a continuation in part under 35 U.S.C. § 119 to both U.S. Ser. No. 16/822,245 filed on Mar. 18, 2020 that is a continuation of U.S. Ser. No. 16/503,519 filed on Jul. 4, 2019, which are fully incorporated herein by reference in their entirety.

BACKGROUND INFORMATION

Field of the Disclosure

Examples of the present disclosure are related to systems and methods associated with a compressible pouch. More particularly, embodiments relate to a compressible pouch with a flap, rear shell, front shell, and a compressible layer positioned between the rear shell and the front shell, wherein a zipper is configured to apply pressure to towards the front shell to squeeze a compartment within the front shell.

Background

Bags are universal in most cultures due to everyone needing to carry objects, protect items, or carry several things together. As such, a wide variety of bags have evolved to meet given standards. When deciding what type of bag to use, most users will be required to use larger bags that can be cumbersome to carry around, but can hold more objects. Unfortunately, many bags take up a considerable amount of space, even if folded. Furthermore, when utilizing a larger bag to store objects within the bag, the objects may move around. This may damage the objects.

Accordingly, needs exist for more effective and efficient methods and systems for a compression pouch with an rear shell and a front shell that are coupled together with a compressible layer, wherein the compressible layer is configured to open and close via a zipper.

SUMMARY

Embodiments are directed towards a compression pouch with a flap, rear shell, compressible layer, and front shell. The compression pouch may be a small refillable pouch, case, storage container, etc. that is configured to store various objects, such as feminine pads, diapers, liners, cosmetics, wallet and keys, other essentials, etc. The compression pouch may allow for easy access of objects without removing the compressive forces applied against the rear shell and front shell. This may allow for a compartment within the front shell.

The flap may have a first end that is configured to be permanently coupled to a proximal surface of the rear shell, and a second end that is configured to be selectively coupled to a distal surface of the front shell. Responsive to decoupling the second end of the flap to the distal surface of the front shell, a compartment within the front shell may be accessed. Further, the compressive zipper may be opened and closed when the second end of the flap is decoupled from the front shell. Responsive to coupling the second end of the flap to the distal surface of the front shell, the compartment may be sealed.

The rear shell may be a piece of fabric that is configured to be a rear sidewall of the compressible pouch. An outer surface of the rear shell may be coupled with the first end of the flap, and an inner surface of the rear shell may be coupled with, and positioned adjacent to, the compression layer.

The compression layer may be positioned between the rear shell and the front shell. The compression layer may be formed of, and filled with, compressible material, which is a different material, or the same material with thinner sidewalls, than the rear shell or front shell. The compression layer may be configured to apply compressive forces against the front shell to shrink a volume of a compartment within the front shell. The compression layer may include a zipper that is configured to be accessed responsive to decoupling the second end of the flap and the distal surface of the front shell. Responsive to opening the flap, the zipper may be exposed. When the zipper is exposed, the compressive forces may be released by opening the zipper or retained.

The front shell may be positioned adjacent to, and in front of, the compression layer. The front shell may include a coupling mechanism and a compartment. The coupling mechanism may be configured to be coupled with the flap to allow objects to be inserted into and removed from the compartment. Responsive to decoupling the flap from the coupling mechanism the compartment may be exposed. The compartment may be positioned on the outer surface of the front shell, and have an opening on the outer surface and top surface of the outer shell. The compartment may be configured to allow users to remove objects from the compressible pouch without removing the compressive forces against the front shell.

In embodiments, the upper and lower edges of the front shell, compression layer, and/or the rear shell may be compressed of or coated with stronger and/or thicker material that shields components of the compression pouch from the elements.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
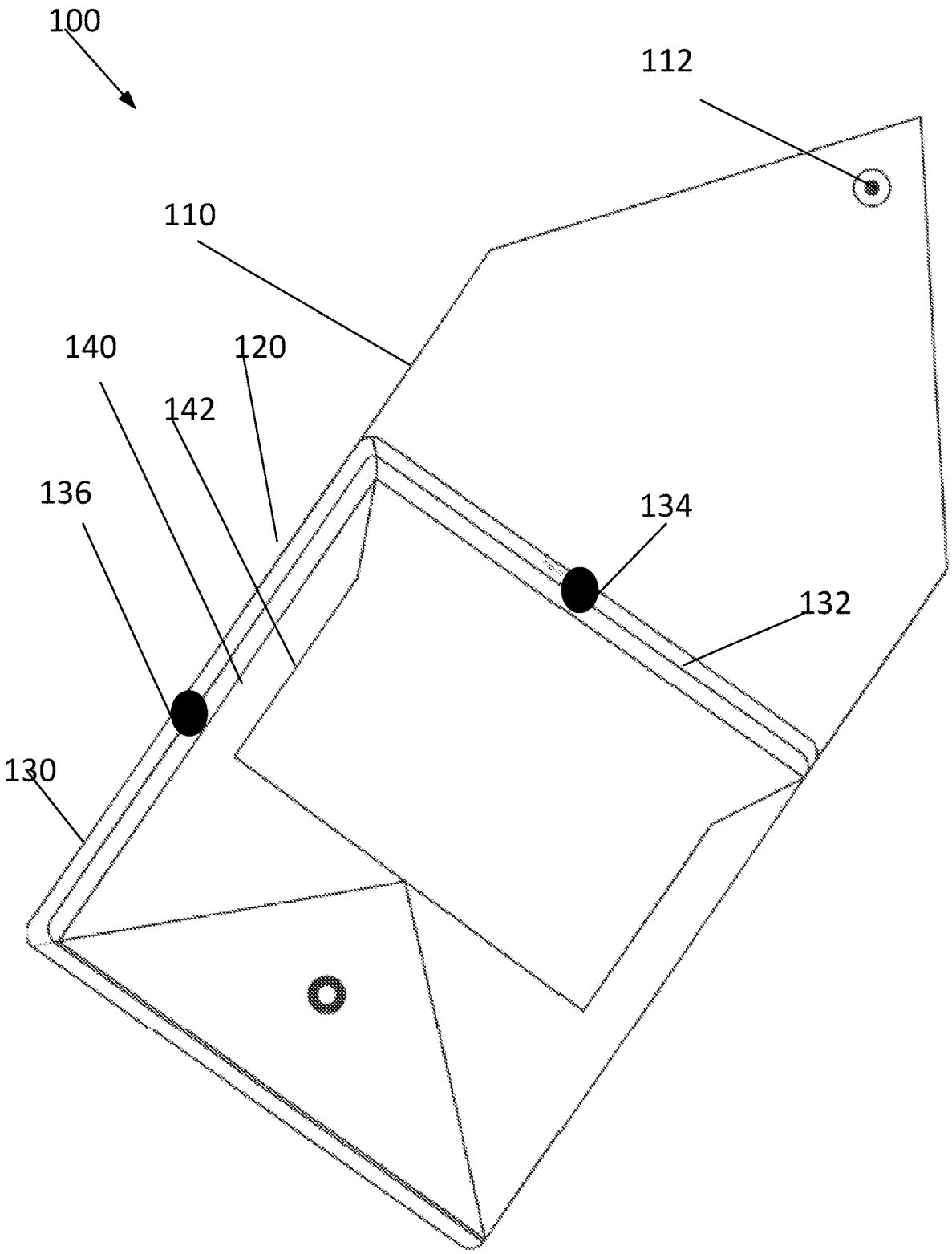
FIG. 1 depicts a front view of a compression pouch, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts one embodiment of a compression pouch 100, according to an embodiment. Compression pouch 100 may include a flap 110, rear shell 120, compressible layer 130, and front shell 140.

Flap 110 may have a first end that is configured to be permanently coupled to a proximal surface of rear shell 120, and a first coupling mechanism 112 that is configured to be selectively coupled to a second coupling mechanism 144 positioned on front shell 140. First coupling mechanism 112 may be any type of coupling mechanism that can selectively couple with second coupling mechanisms 144, such as buttons, hoop and loops, buckles, etc. Responsive to decoupling first coupling mechanism 112 and second coupling mechanism 144, a compartment 142 positioned on front shell 140. Responsive to coupling first coupling mechanism 112 and second coupling mechanism 144, compartment 142 may be sealed. In embodiments, flap 110 may have a body that is substantially rectangular in shape with a triangular shape end or be rectangular in shape.

Rear shell 120 may be a piece of fabric that is configured to be a rear sidewall of compressible pouch 100. An outer surface of rear shell 120 may be coupled with the first end of flap 110, and an inner surface of rear shell 120 may be coupled with a positioned adjacent with compressible layer 130.

Compressible layer 130 may be positioned between rear shell 120 and front shell 140. Compressible layer 130 may be comprised of a compressible material, such as compressible foam, nylon, rubber, etc. In embodiments, compressible layer 130 may be formed of a different material than rear shell 120 or front shell 140. Compressible layer 130 may be configured to apply forces against front shell 140 to increase or reduce the volume associated with compartment 142. Compressible layer 130 may be formed of a first layer and second layer, which are coupled together in part via a zipper on a zipper track 132. The first layer of compressible layer 130 may be positioned adjacent to rear shell 120, and the second layer positioned adjacent to front shell 140. The zipper may be configured to move on zipper track 132 to increase or decrease the compression forces created by compressible layer 130 against compartment 142. In embodiments, responsive to fully closing zipper on zipper track 132 the maximum compression forces may be applied against compartment 142, which may reduce the volume of compartment 142. Responsive to fully opening zipper on zipper track 132 minimal compression forces may be applied against compartment 142, which may not reduce the volume of compartment 142. In embodiments, the zipper track 132 may be configured to have a first end point 134 on an upper surface of compressible layer 130, rotate six hundred third degrees and have a second end point 136 on a sidewall of compressible layer 130. In embodiments, second end point 136 may be vertically positioned below a lower edge of compartment 142. By having the zipper track 132 fully circumnavigate the boundary of compressible layer 130, the compression forces generated by compressible layer 130 may be maximized and retained. Due to the positioning of zipper track 132 behind compartment 142 and in front of rear shell 120, compartment 142 may be accessed without modifying the zipper placement along track 132. In implementations, first end point 134 may be a starting position of the zipper on track 132 when the compression layer 130 is fully closed, and the zipper moves towards second end point 136 to open the compression layer 130. Second end point 136 may be a starting position of the zipper on track 132 when the compression layer 130 is fully opened, and the zipper moves towards first end point 136 to close the compression layer. This may enable flap 110 to cover the zipper when compression layer 130 is closed.

Also, by having the second end point 136 of zipper track 132 on a sidewall of compression layer 130 that is not covered by flap 140, the placement of the zipper and relative compression forces may be adjusted even while flap 140 is positioned over compartment 142 and the start point 132 of the zipper. Additionally, by positioning second end point 136 of zipper track 132 on a lower portion of the sidewall of compressible layer 130, the compression forces may be angled towards the opening of compartment 142, assisting users remove objects from compartment 142.

Front shell 140 may be positioned adjacent to, and in front of compression layer 130. Front shell 140 may include compartment 142 and second coupling mechanism 144. Compartment 142 may have an opening along an upper edge of front shell 140 and on an outer face of front shell 140. Compartment 142 may be configured to allow users to remove objects from compressible pouch 100 without removing the compressive forces against front shell 140. This may enable other objects positioned within compartment 142 to be secured in place. Second coupling mechanism 144 may be positioned between lower edges of compartment 142 and front shell 140, and may be configured to be coupled with first coupling mechanism 112. By positioning second coupling mechanism 144 below the lower edge of compartment 142, objects may be secured in place while first coupling mechanism 144 is secured to first coupling mechanism 112.

Figure 2:
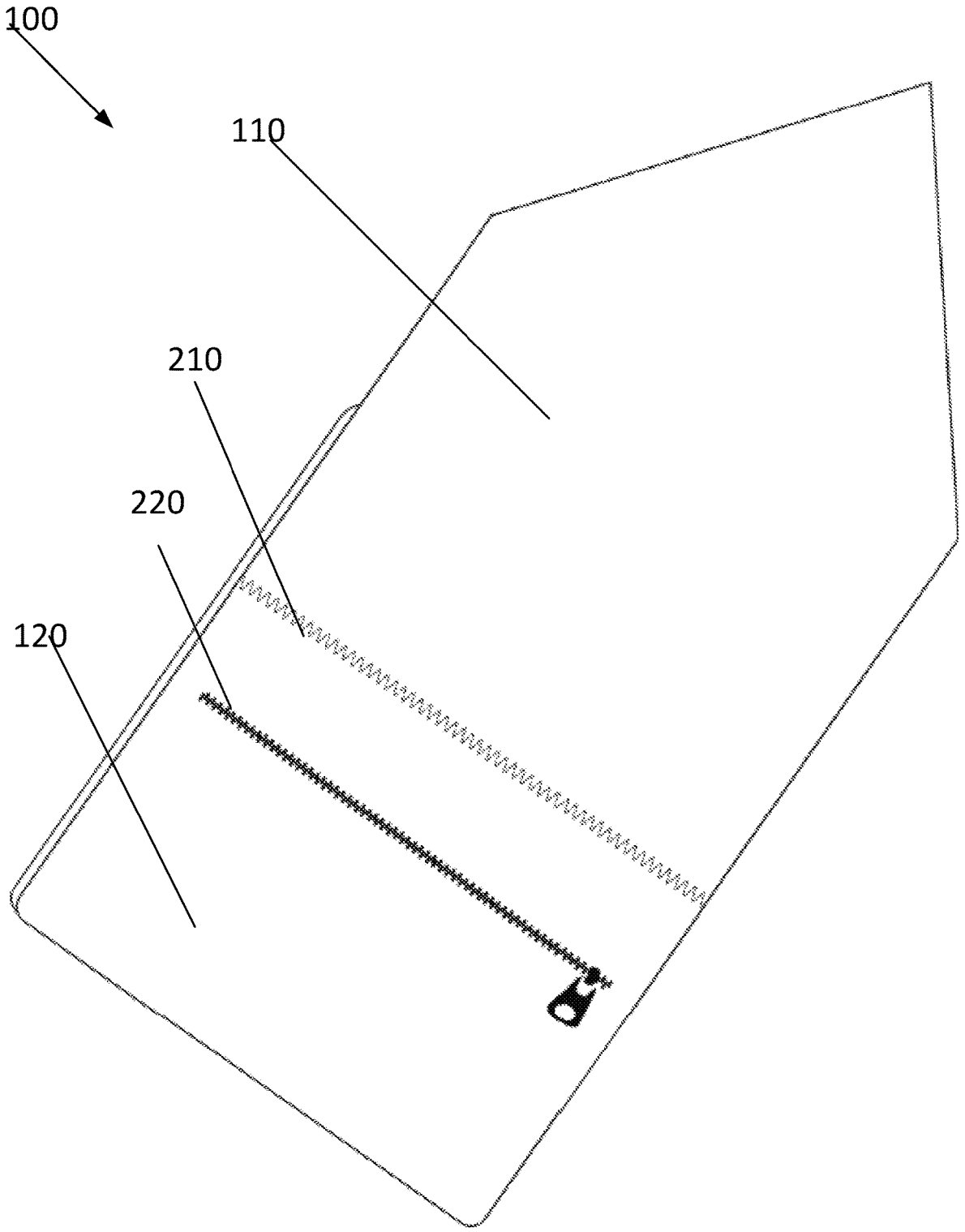
FIG. 2 depicts a rear view of a compression pouch, according to an embodiment.

FIG. 2 depicts a rear view of compression pouch 100, according to an embodiment. As depicted in FIG. 2, compression pouch 100 may include a hem line 210, which extends across an outer surface of rear shell 120.

Further, a second zipper 220 may be positioned across the outer surface of rear shell 120. Second zipper 220 may be configured to open and closer a second compartment embedded within rear shell 120. The second compartment may be independent from the compartment on the front shell.

Figures 3, 4:
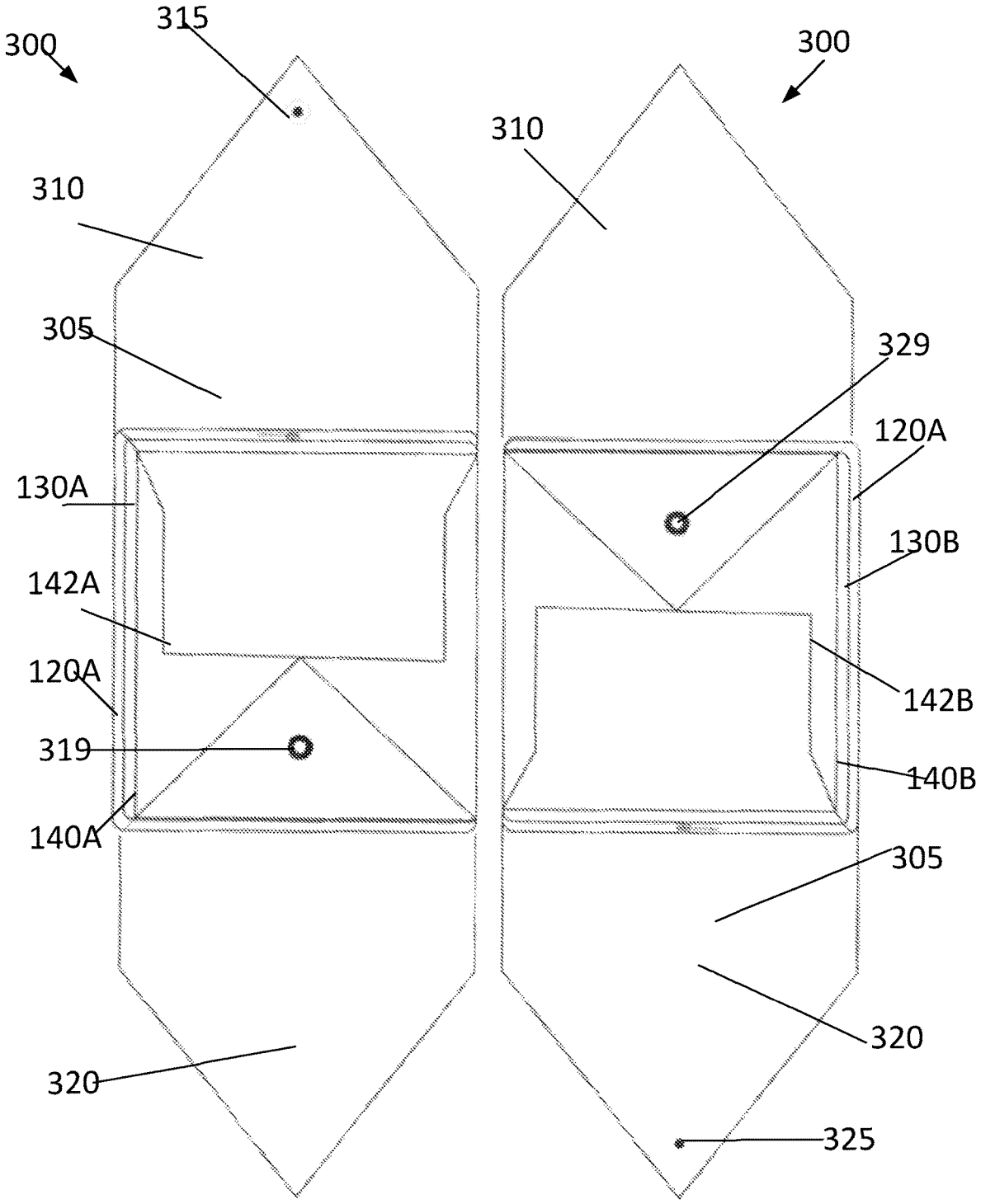
FIG. 3 depicts a front view of an alternative compression pouch, according to an embodiment.
FIG. 4 depicts a rear view of an alternative compression pouch, according to an embodiment.

FIG. 3 depicts a front view of compression pouch 300 and FIG. 4 depicts a rear view of compression pouch 300, according to an embodiments. Elements depicted in FIGS. 3 and 4 may be described above, and for the sake of brevity these elements may be omitted. As depicted in FIGS. 3 and 4, each face of compression pouch 300 may include an independent rear shell, compression layer, and front shell.

As further depicted in FIGS. 3 and 4, a flap layer 305 may be configured to be sandwiched between inner surfaces of rear shells 120A and 120B, and extend away from the bodies of rear shells 120A and 120B. A first flap 310 may be configured to be positioned on a first end of flap layer 305, and a second flap 320 may be positioned on a second end of flap layer 305. First flap 310 may have a coupling mechanism 315 that is configured to be selectively coupled with a coupling mechanism 319 positioned on front shell 140A. Second flap 320 may have a second coupling mechanism 325 that is configured to be selectively coupled with a coupling mechanism 239 positioned on front shell 140B. As such, each face of compression pouch 300 may have an independent compartment 142A, 142B that is selectively coupled by an independent flap 310, 320, respectively. Further, each side has its own compression layer 130A, 130B that can independently control the compression forces applied to a respective compartment 142A, 142B.

Figure 5:
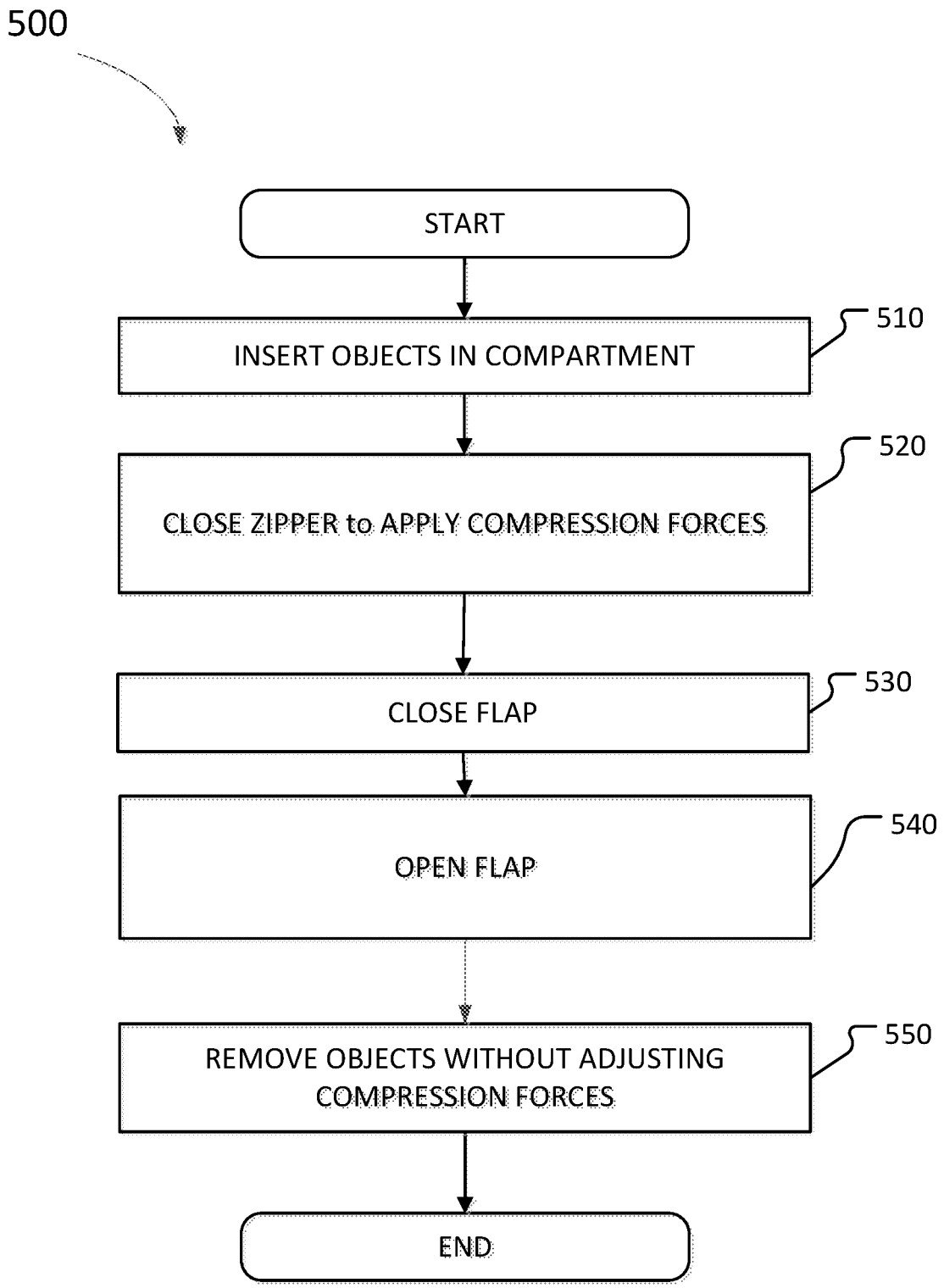
FIG. 5 depicts a method of using a compression pouch to store objects, according to an embodiment.

FIG. 5 illustrates a method 500 for utilizing a compression pouch, according to an embodiment. The operations of method 500 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting.

At operation 510, objects may be inserted into a compartment, wherein the compartment is positioned on a front shell of a compression pouch.

At operation 520, a zipper that circumnavigates a boundary of a compression layer may be closed. Responsive to closing the zipper, the compression layer may apply compression forces against the compartment to minimize a volume of the compartment.

At operation 530, a flap may be closed over top edges of a rear shell, the compression layer, and the front shell. This may secure the objects within the container.

At operation 540, the flap may be opened, exposing the top edges of the rear shell, the compression layer, and the front shell.

At operation 550, objects within the compartment may be removed without opening the zipper.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems and methods according to various embodiments of the present invention. In this regard, each block in the flowcharts or block diagrams may represent a segment, which comprises one or more steps.

What is claimed is:

1. A compression pouch comprising:

a rear shell;

a front shell with a compartment, the compartment having an opening on a front face of the front shell and an upper edge of the front shell;

a compression layer filled with compressible material, the compression layer being positioned between the front shell and the rear shell, the compression layer being configured to apply compressive forces against the front shell to reduce a volume of the compartment;

a zipper track positioned on an outer surface of the compression layer, the zipper track configured to turn more than six hundred thirty degrees around the compression layer wherein when the zipper track is closed the compressive layer applies the compressive forces against the front shell and when the zipper track is open the compressive layer removes the compressive forces applied against the front shell;

a flap with a first end that is permanently coupled to the rear shell, and a second end that is configured to be selectively coupled to the front face of the front shell, the flap extending along an entirety of a width of the rear shell, the flap being configured to open to expose the opening on the front face of the front shell and the upper edge of the front shell when the zipper track is open and when the zipper track is closed, wherein portions of the zipper track are covered by the flap when the flap is selectively coupled to the front shell.

2. The compression pouch of claim 1, further comprising:

a first coupling mechanism position on the flap;

a second coupling mechanism positioned on the front shell.

3. The compression pouch of claim 1, wherein the compartment is configured to be exposed by decoupling the flap with the front shell.

4. The compression pouch of claim 3, wherein the compressive forces against the front shell are retained when the flap is decoupled from the front shell.

5. The compression pouch of claim 4, wherein a zipper track start is positioned on an upper edge of the compression layer, and a zipper track end is positioned on a sidewall of the compression layer at a position below a lower edge of the compartment.

6. The compression pouch of claim 5, wherein the compartment has an exposed face and upper edge.

7. The compression pouch of claim 6, wherein the flap is configured to cover the zipper track start and the upper edge of the compartment when the first coupling mechanism is coupled to the second coupling mechanism.

8. The compression pouch of claim 1, including a plurality of flaps coupled to a flap body, the plurality of flaps including the flaps.

9. The compression pouch of claim 1, wherein the plurality of flaps are configured to be coupled to opposite faces of the compression pouch body.

10. The compression pouch of claim 1, wherein the flap body is positioned between two rear shells, the two rear shells including the rear shell.

11. A method associated with a compression pouch comprising:

positioning a compression layer between a front shell and a rear shell, the compression layer being filled with compressible material;

closing the compression layer to apply compressive forces against the front shell to reduce a volume of a compartment, the compartment having an opening on a front face of the front shell and an upper edge of the front shell, wherein closing the compression layer includes moving a zipper along a zipper track, the zipper track being positioned on an outer surface of the compression layer, the zipper track rotating more than six hundred thirty degrees around the compression layer, wherein when the zipper track is closed the compressive layer applies the compressive forces against the front shell and when the zipper track is open the compressive layer removes the compressive forces applied against the front shell;

permanently coupling a flap with a first end to the rear shell; and selectively coupling a second end to the front face of the front shell;

opening the flap opening to expose the opening on the front face of the front shell and the upper edge of the front shell;

closing the flap when the zipper track is closed, wherein portions of the zipper track are covered by the flap when the flap is selectively coupled to the front shell.

12. The method associated with claim 11, further comprising:

positioning a first coupling mechanism on the flap;

positioning a second coupling mechanism on the front shell.

13. The method associated with claim 11, further comprising:

exposing the compartment by decoupling the flap with the front shell.

14. The method associated with claim 13, further comprising:

retaining the compressive forces against the front shell when the flap is decoupled from the front shell.

15. The method associated with claim 14, further comprising:

positioning a zipper track start is positioned on an upper edge of the compression layer; and positioning a zipper track end on a sidewall of the compression layer at a position below a lower edge of the compartment.

16. The method associated with claim 15, wherein the compartment has an exposed face and upper edge.

17. The method associated with claim 16, further comprising:

covering, via the flap, the zipper track start and the upper edge of the compartment when the first coupling mechanism is coupled to the second coupling mechanism.

18. The method associated with claim 11, including a plurality of flaps coupled to a flap body, the plurality of flaps including the flaps.

19. The method associated with claim 11, wherein the plurality of flaps are configured to be coupled to opposite faces of the compression pouch body.

20. The method associated with claim 11, further comprising:

positioning the flap body is between two rear shells, the two rear shells including the rear shell.

* * * * *